US007617852B2

(12) United States Patent
Perini

(10) Patent No.: US 7,617,852 B2
(45) Date of Patent: Nov. 17, 2009

(54) APPARATUS FOR TEMPORARILY HOLDING LOGS WITHIN CUTTING-OFF MACHINES

(76) Inventor: Fabio Perini, Via S. Francesco 1, I-55049 Viareggio (Lucca) (IT)

( * ) Notice: Subject to any disclaimer, the term of this patent is extended or adjusted under 35 U.S.C. 154(b) by 806 days.

(21) Appl. No.: 10/548,616

(22) PCT Filed: Mar. 22, 2004

(86) PCT No.: PCT/IT2004/000138

§ 371 (c)(1),
(2), (4) Date: Sep. 8, 2005

(87) PCT Pub. No.: WO2004/094117

PCT Pub. Date: Nov. 4, 2004

(65) Prior Publication Data

US 2006/0169357 A1 Aug. 3, 2006

(30) Foreign Application Priority Data

Apr. 24, 2003 (IT) ..... FI2003A0114

(51) Int. Cl.

| | |
|---|---|
| ***B27C 9/00*** | (2006.01) |
| ***B27M 3/00*** | (2006.01) |
| ***B27L 9/00*** | (2006.01) |
| ***B27L 3/00*** | (2006.01) |
| ***B27L 5/00*** | (2006.01) |

(52) U.S. Cl. ..... 144/1.1; 144/2.1; 144/3.1

(58) Field of Classification Search ..... 144/3.1; 198/442, 419.2; 242/521; 29/822; 414/18; 269/54.2, 266, 43; 83/155, 174, 508, 508.1, 83/508.2, 113, 107, 175, 466, 465, 457, 459, 83/375, 466.1, 650

See application file for complete search history.

(56) References Cited

U.S. PATENT DOCUMENTS

| | | | | |
|---|---|---|---|---|
| 3,045,728 | A * | 7/1962 | Hutchinson et al. | 144/208.8 |
| 3,213,731 | A * | 10/1965 | Renard | 83/174 |
| 3,603,362 | A * | 9/1971 | Neild | 269/54.2 |
| 3,844,398 | A * | 10/1974 | Pinat | 198/626.6 |
| 3,905,260 | A * | 9/1975 | Nystrand | 83/155 |
| 4,026,752 | A * | 5/1977 | Hartbauer et al. | 156/457 |
| 4,294,444 | A * | 10/1981 | Horton | 269/156 |
| 4,338,986 | A * | 7/1982 | Detjen | 144/39 |
| 4,368,913 | A * | 1/1983 | Brockmann et al. | 294/106 |

(Continued)

FOREIGN PATENT DOCUMENTS

| | | |
|---|---|---|
| IT | 1247330 | 4/1991 |
| WO | WO 01/41982 A2 | 6/2001 |

*Primary Examiner*—Dana Ross
*Assistant Examiner*—Jennifer Chiang
(74) *Attorney, Agent, or Firm*—McGlew and Tuttle, P.C.

(57) ABSTRACT

An apparatus for temporarily holding logs within cutting-off machines including two plates (60), each of which exhibits a plurality of pressers (61) and an appendix sliding within a guide (7). The plates (60) are associated with an actuator (8) which drive them, under control, in a substantially straight movement in the direction of the relevant guides (7). The pressers are disposed in mirror-like and parallel relationship to each other, that is, orthogonally to the logs (2) to be treated.

11 Claims, 9 Drawing Sheets

U.S. PATENT DOCUMENTS 5,263,522 A * 11/1993 Sasko ..... 144/208.9
5,301,533 A 4/1994 Jackson
5,680,802 A * 10/1997 Murray ..... 83/23
6,044,962 A * 4/2000 Vaughn ..... 198/598
6,267,544 B1 * 7/2001 Neville ..... 414/23
6,485,266 B2 * 11/2002 DeRuyter ..... 417/201
6,532,851 B2 * 3/2003 Moss et al. ..... 83/466
2002/0078811 A1 6/2002 Moss et al.
2002/0121170 A1 * 9/2002 Gambaro et al. ..... 83/154

* cited by examiner

APPARATUS FOR TEMPORARILY HOLDING LOGS WITHIN CUTTING-OFF MACHINES

BACKGROUND OF THE INVENTION

The present invention, refers to an apparatus for temporarily holding logs within cutting-off machines.

In the following text, the term "logs" is meant to indicate rolls of web material (such as paper) wound up around a support core (for example, a tubular cardboard core), to be cut to form rolls of smaller length, that is, of commercial size.

At present, the production of paper rolls is known to involve cutting transversally the logs, produced by a rewinding machine, by using one or more cutting-off machines.

A cutting-off machine for logs is described in details in the patent IT-1247330.

Essentially, a cutting-off machine of this type comprises:

- a plurality of channels or guides into which the logs are discharged and in correspondence of which movable devices, so-called "porters" in jargon, are mounted to drive the logs into longitudinal motion by pushing them from behind;
- a cutting station, comprising one or more circular blades, rotating about axes parallel to those of the logs and fixed on a corresponding movable support;
- means for temporarily holding the logs in said cutting station.

During the normal operation, a log to be cut is disposed, by a relevant porter, in a preset position on the respective guide and blocked in such position; then, one of the blades is actuated, that is, it is driven into a plane orthogonal to the axis of the log, so as to form a shorter roll of preset size therefrom. The length of the roll depends, actually, on the advancement of the porter during the time elapsing between two consecutive cuts operated by the blades.

In particular, the means currently used to hold temporarily the logs in the cutting station, means which are commonly called "pressers", comprise a plurality of belts associated with corresponding driving members by which the configuration of said pressers can be modified in order to hold the logs during the cutting steps and release them when they have to be moved.

However, the traditional pressers result inadequate to the current production requirements, both in terms of reliability in the long run, especially as far as the operation flexibility is concerned, and of service demands.

The main object of the present invention is to overcome the said drawbacks.

This result has been achieved, according to the invention, by adopting the idea of making a structure having the characteristics described in claim 1. Further characteristics being set forth in the dependent claims.

SUMMARY OF THE INVENTION

The present invention makes it possible to operate an effective and safe hold of the logs during the cutting step, and to ensure, also thanks to the rigidity of the components that make up the apparatus, the highest readiness in the response to the commands given by the actuators in charge of the operation of the holding means. Besides, owing to the particular handling of the pressers, the apparatus can automatically fit to the diameter of the concerned logs, whatever the extent of such diameter, without necessitating replacement of parts or components of the apparatus, so that the maximum versatility of the latter is thus ensured. In addition, an apparatus according to the invention requires very little maintenance, is relatively simple to fabricate, cost-effective and reliable even after a prolonged service life.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DESCRIPTION OF THE PREFERRED EMBODIMENT

Figure 1:
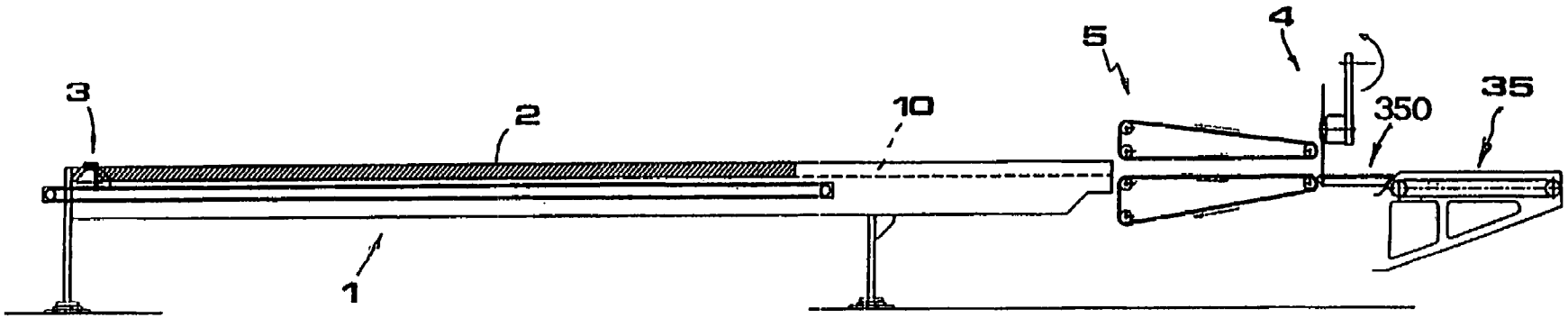
FIG. 1 is a schematic side view of an apparatus for feeding logs to a cutting station, showing the step at the beginning of a work cycle.

The present invention will be described herebelow, with reference to the figures of the attached drawings, as applied to a device for moving the logs toward the cutting station, comprising:

- a platform (1) with one or more longitudinal channels (10) inside which the logs to be cut are disposed;
- pusher means (3) acting in correspondence of said platform (1) and intended for acting on the back of the logs (2) to push them, along the respective guide channels (10), toward cutting means (4) disposed downstream;
- clamping means (5) disposed intermediate between said pusher means (3) and said cutting means (4) and intended for engaging the logs (2) which are pushed along the channels (10) of platform (1) by the pushers (3) and driving them along as far as said cutting means (4).

Figure 14:
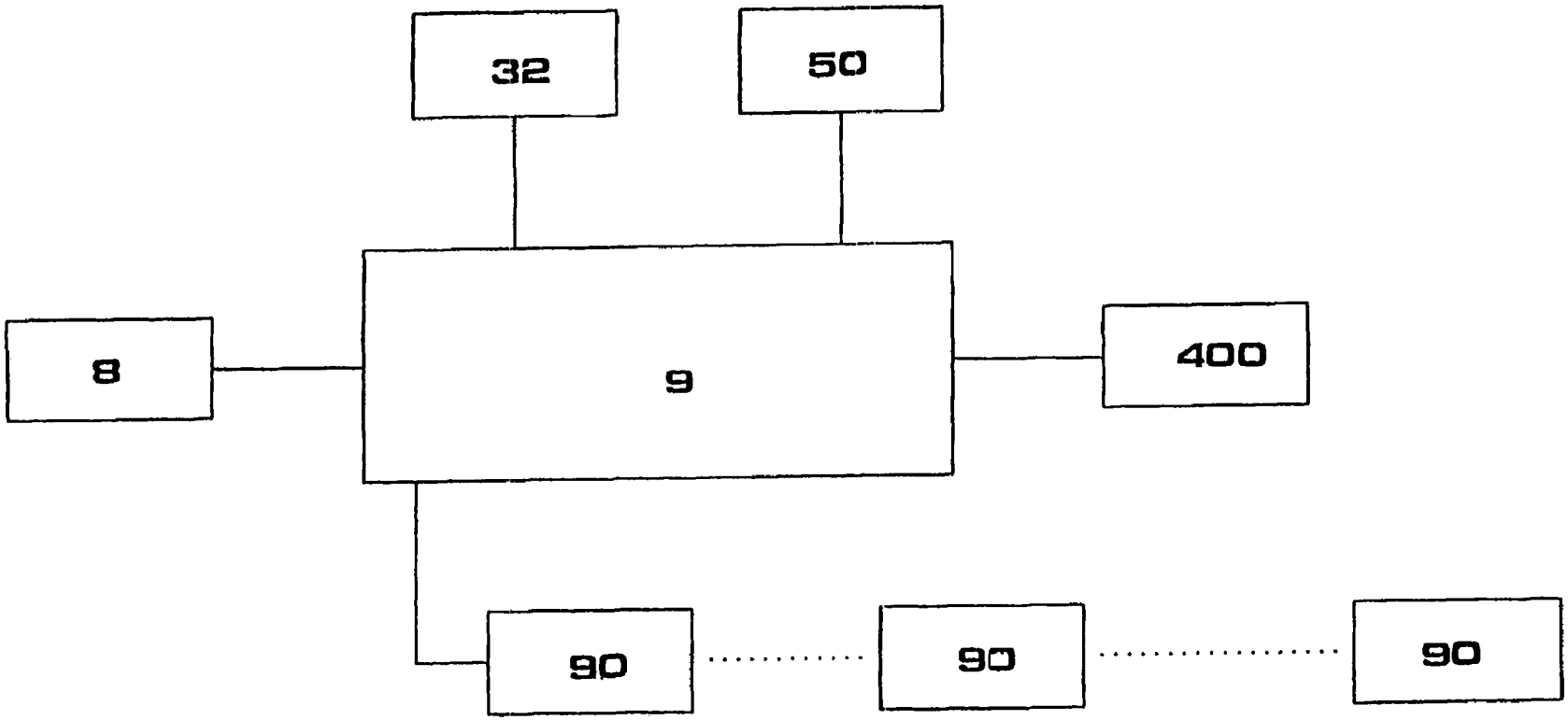
FIG. 14 is a simplified block diagram of the automatic drive and control means.

The said pusher means (3) comprise a bar (30) disposed transverse to the channels (10) of platform (1) and moved to and from the said clamping means (5) by a carriage (31) associated with a corresponding electric motor (32) (see block diagram of FIG. 14) and mounted for sliding on the two long sides of platform (1).

Moreover, the said clamping means (5) are made up of two motor-driven, loop-closed belts (50) disposed opposite to each other, with respect to the plane (2) on which the logs (2)

arrive sliding on the platform (1), so that each belt will always exhibit a length (51) parallel to such plane: the lengths (51) facing each other (51) of said belts (50) being spaced apart of an extension substantially equal to the outer diameter of the logs (2).

With reference to the attached drawings, the said cutting means (4) comprise a blade (40) mounted on a support arm (41) which is associated with a relevant actuator (400) (see block diagram of FIG. 14) to drive it into motion from and to the logs (2) to be cut.

Figure 2:
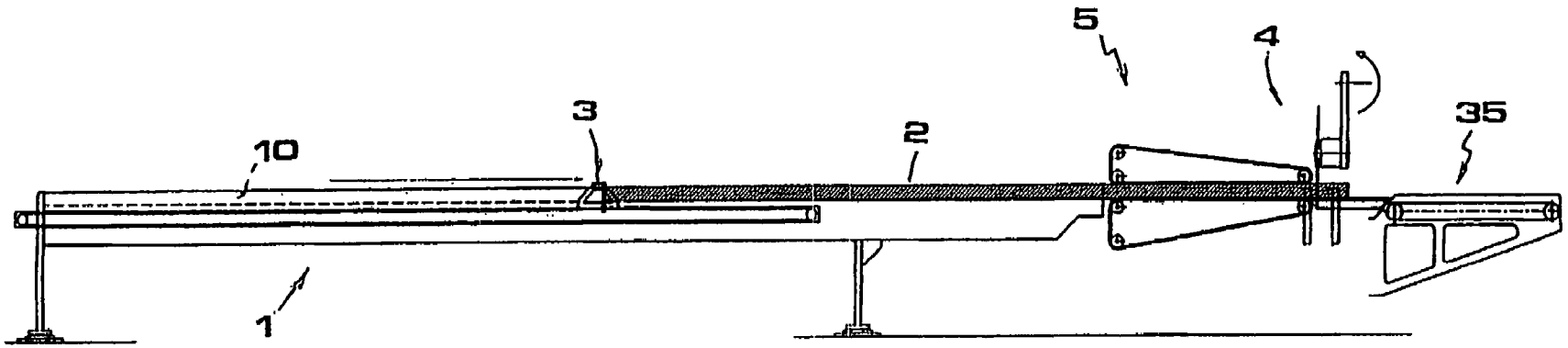
FIG. 2 shows the apparatus of FIG. 1 with a log engaged by clamping means and subjected to a cutting operation.
Figure 3:
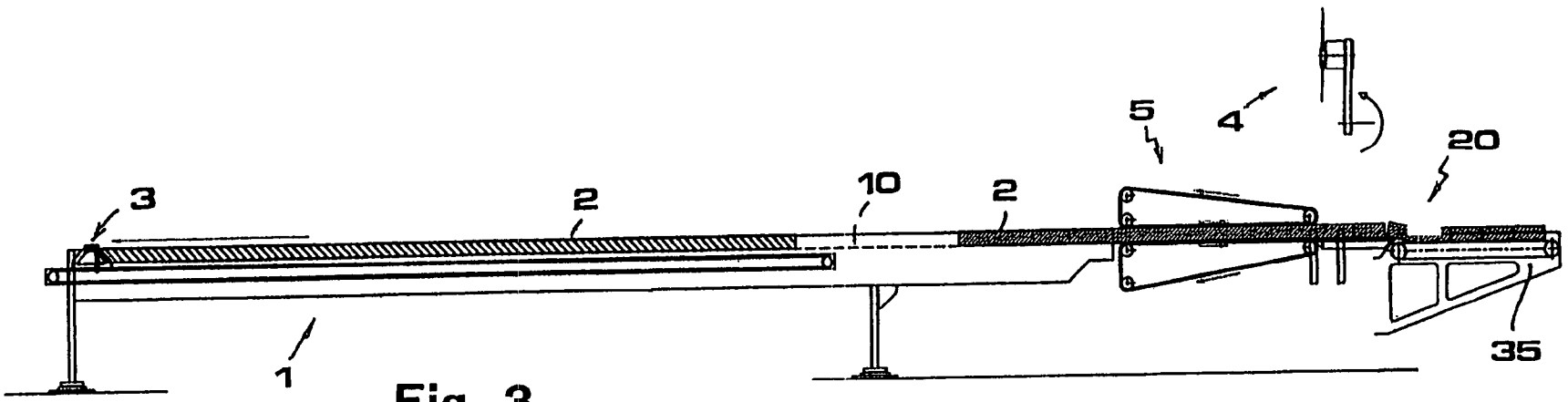
FIG. 3 shows the apparatus of FIG. 1 with another log loaded onto the respective channel of the platform for the sliding of the logs.
Figure 4:
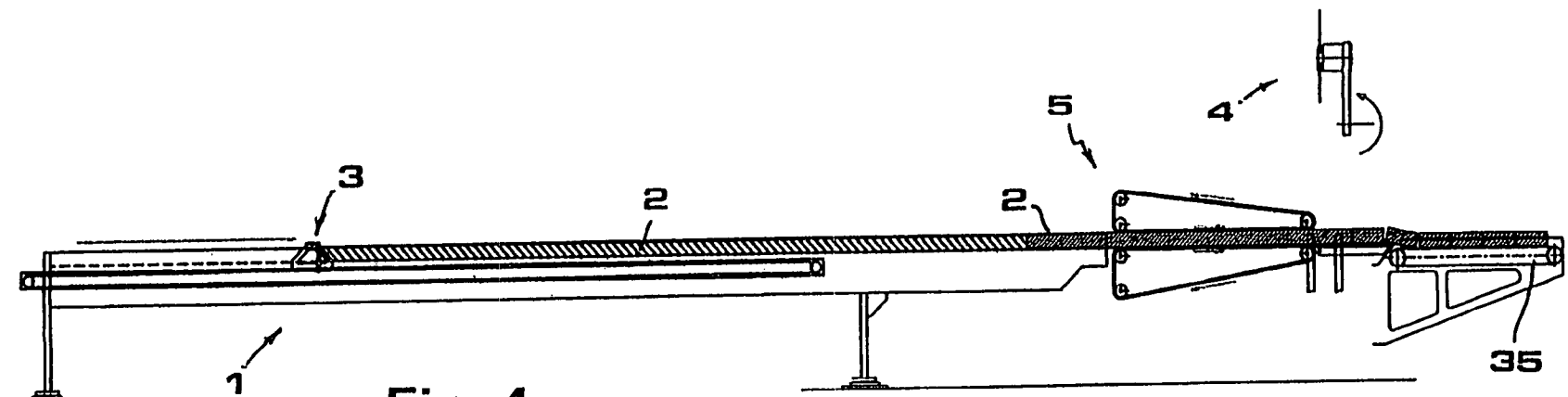
FIG. 4 shows the apparatus of FIG. 1 with two logs lined up one after the other.
Figure 5:
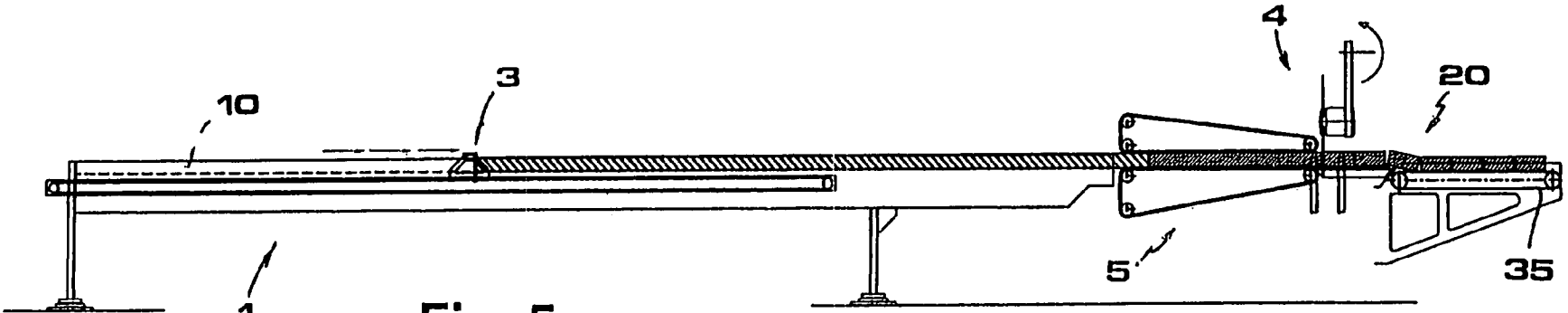
FIG. 5 shows the apparatus of FIG. 4 with the second log having its head section positioned between the clamping means.
Figure 6:
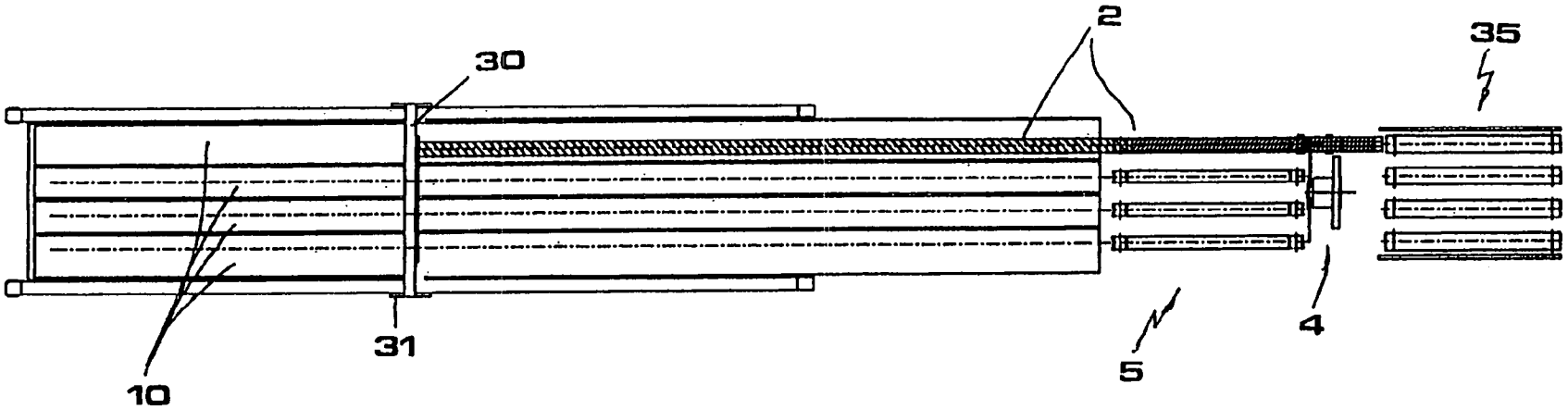
FIG. 6 shows a plan view of the apparatus of FIG. 5.
Figure 7:
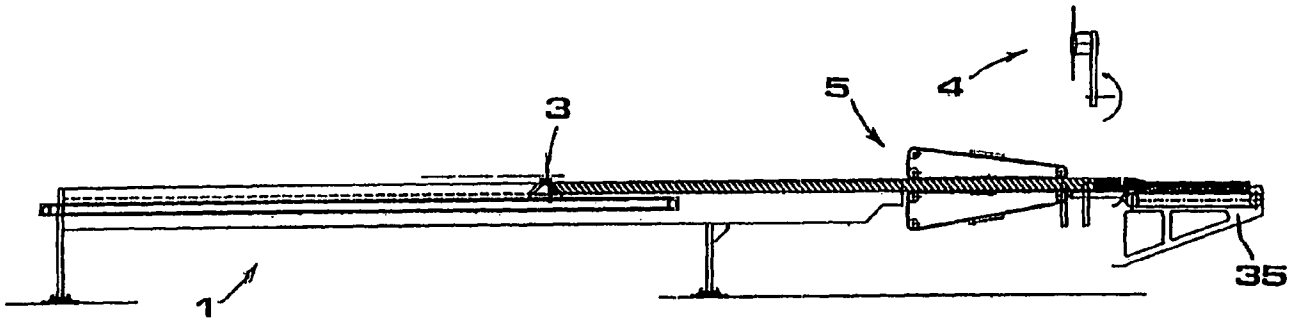
FIGS. 7 and 8 show the same apparatus in two operating steps that follow the one represented in FIG. 6.
Figure 8:
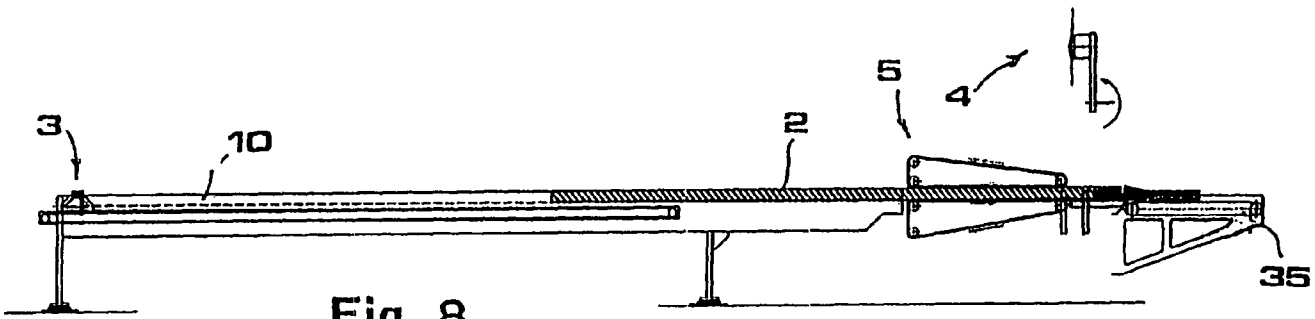
Figure 9:
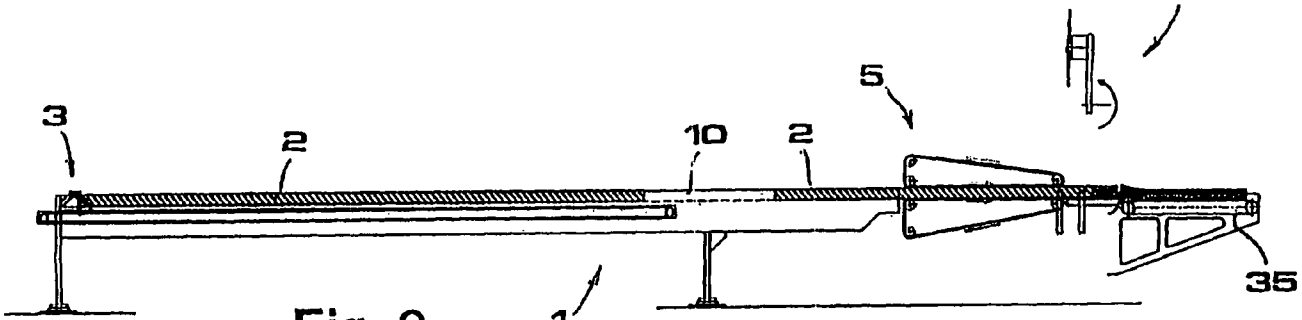
FIG. 9 shows again the same apparatus in a further step, with another log loaded on the platform.

The operation of the above described apparatus is as follows. The logs (2) are disposed in the channels (10) of platform (1) by automatic loading devices (known to those skilled in the art and, therefore, not to be described herein in details), and the pusher means (3) provide for pushing them toward the belts (50) as far as between the parallel lengths (51) of the latter (FIGS. 1 and 2). At this point, each log (2) thus positioned results held between the same belts (50) which, by rotating on respective driving-out rollers, direct the log toward the cutting means (4), as illustrated in FIG. 3, and engage the same log on diametrically opposite surface portions thereof. The movement of the belts (50) and thus of logs (2), is intermittent and in synchronism with the cutting means (4): in correspondence of each dwell, the means (4) are active, so that the logs (2) are cut, whereas during the movement of belts (50) the means (4) are inoperative and away from the logs (2). The speed and time of operation of the belts (50) are predetermined in relation to the length of paper rolls (20) to be obtained from the cutting of the logs (2). Once the logs (2) are held between the belts (50), the carriage (31) moves back to take up the relevant initial position, so that, when disposing further logs (2) in the channels of platform (1), these logs can be driven, again by the same pusher means, as far as to dispose the relevant head portions thereof in contact with the tail sections of the logs (2) previously handed over to the belts (50), as illustrated in FIG. 4. This process is cyclically repeated, as illustrated also in FIGS. 5-9. It thus follows that the feeding of the logs (2) to the cutting means is performed continuously, that is, without interruptions or empty spaces between consecutive logs, with evident advantages in terms of actual production of the system. The rolls, as they are produced, (20) are pushed by the same logs being treated (2) onto a conveyor belt (35) located downstream of the cutting means (4) which provides for moving them away. Possibly disposed between the conveyor belt (35) and the cutting means (4) is a stationary horizontal plane (350).

In correspondence of the cutting means (4), there may be provided means (6) intended for temporarily retaining the logs (2) during the cutting step, that is, when the cutting means are activated.

The said retention means (6), according to the exemplary embodiment illustrated in the figures of the attached drawings, comprise two plates (60*a*, 60*b*) each of which exhibits, on one side, a plurality of rigid, substantially semicircular hooks—hereinafter referred to as "pressers"—and, on the opposite side, an appendix (600) slidingly fitted within a guide (7) inclined at a predetermined angle to the vertical: the said plates (60*a*, 60*b*) being associated with an actuator (8) which, under control, drive them into a substantially rectilinear motion in the direction of the respective guides (7), and the same plates being disposed in mirror-like and parallel relationship, that is, orthogonally to the logs (2) to be treated.

The appendixes (600) of said plates (60*a*, 60*b*) are provided with small rollers (63) to assist the sliding thereof within the respective guides (7).

Preferably, the said guide (7) is inclined at an angle of 60° to 65° to the vertical in order to combine, in a way which is deemed to be optimal, the vertical and horizontal components of the displacement of each presser (61), and to allow the apparatus to work as best as possible whatever the diameter of the logs under treatment, thus resulting extremely versatile.

For example, the said actuator (8) may be an electric motor connected to the two plates (60*a*, 60*b*) via a transmission device of crank-connecting rod type (80, 81) acting on pivots (83) going through the two plates (60*a*, 60*b*): the said plates (60*a*, 60*b*) being engaged to a fixed body (100) via corresponding levers (108) each of which, on one side, is hinged to one of the two fixed bodies (100) and, on the other side, is hinged to one of the two plates (60*a*, 60*b*) above said pivots (83). The axes of the hinges, connecting the levers (108) with the plates (60*a*, 60*b*), being parallel to the pivots (83).

Figure 10:
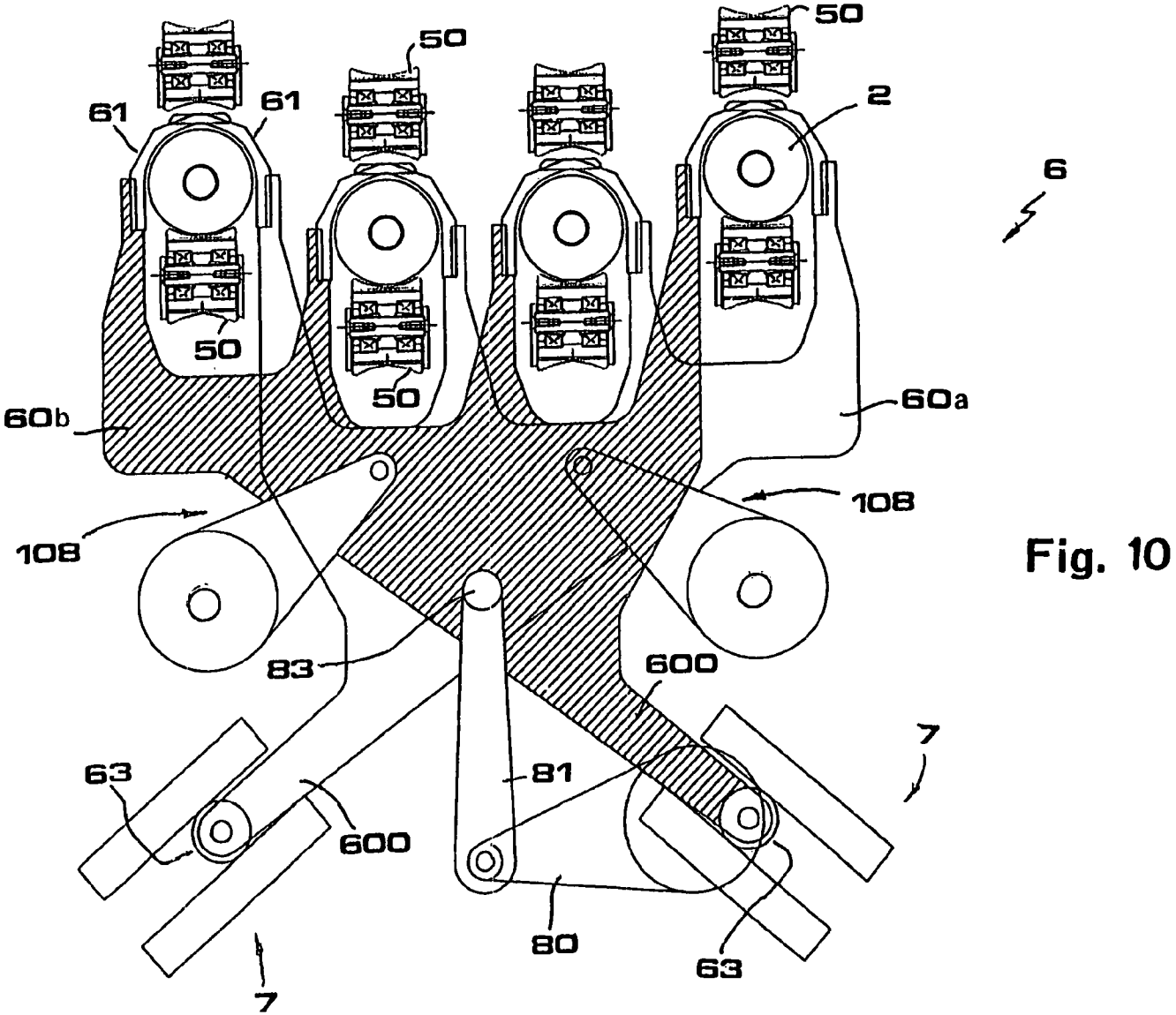
FIGS. 10 and 11 are schematic front views of the configurations taken up by the means for the temporary retention of logs of different diameter in the cutting-off station, respectively.
Figure 11:
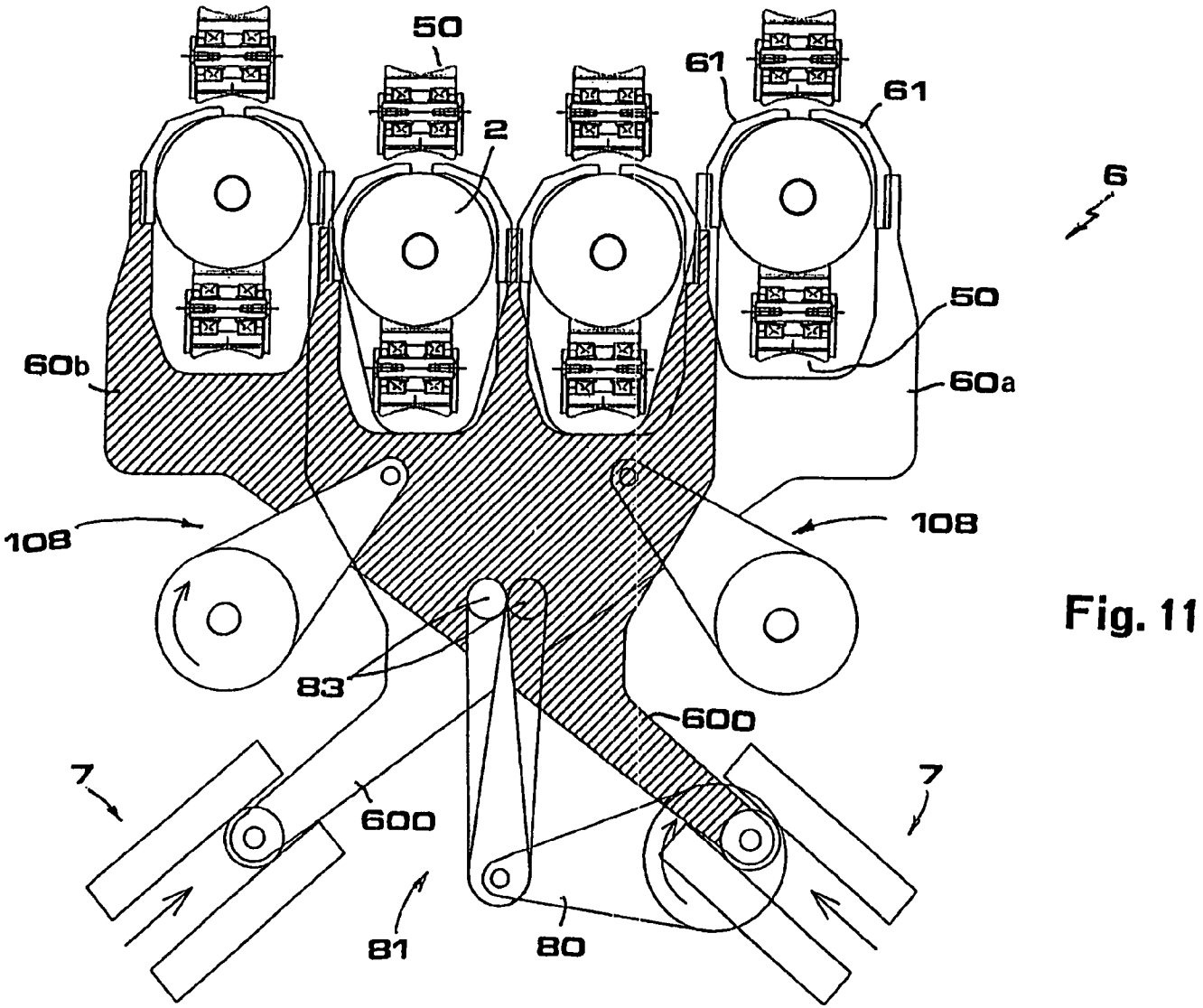
Figure 12:
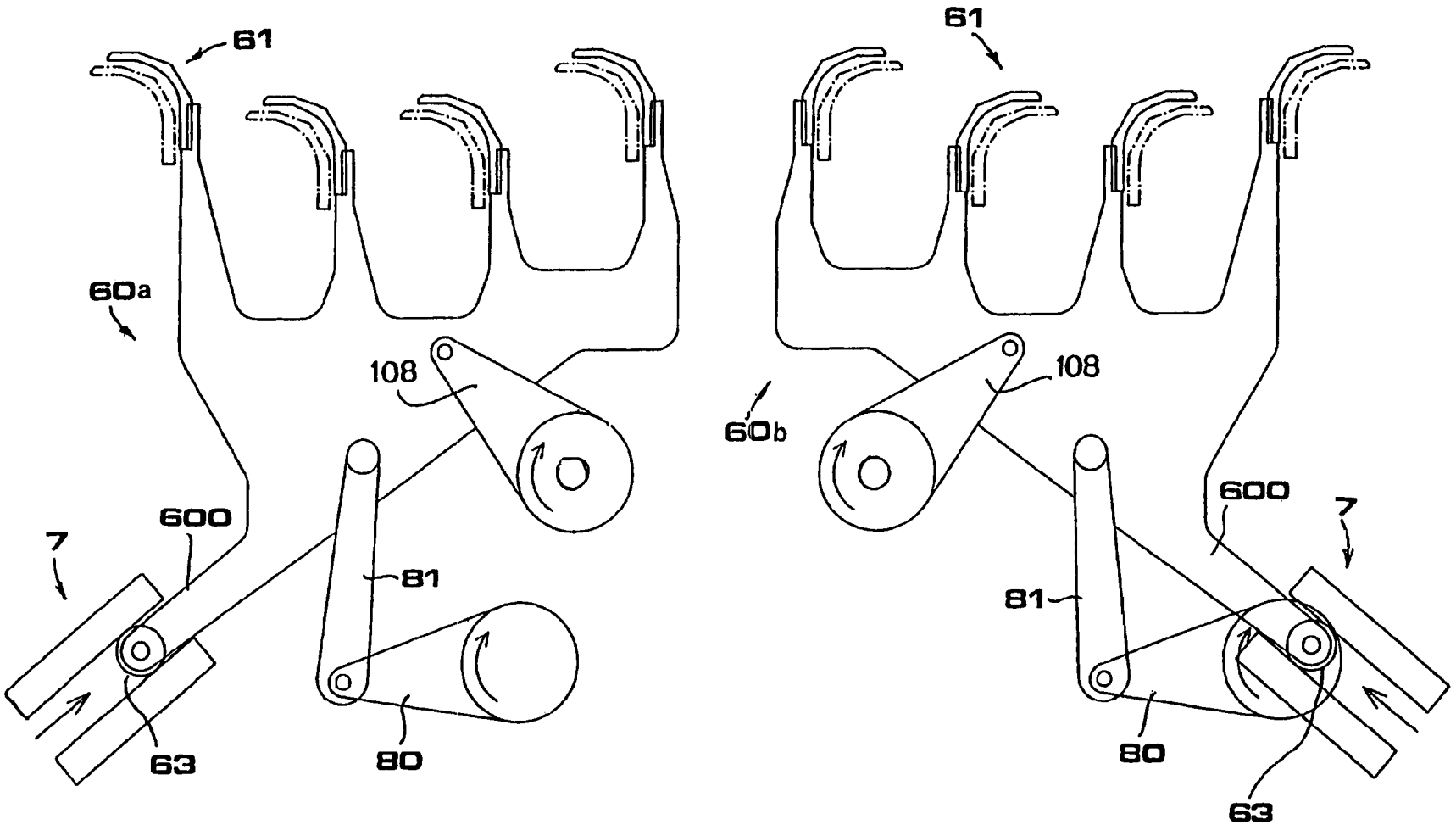
FIG. 12 is a schematic exploded side view of the retention means illustrated in FIGS. 10 and 11.
Figure 13:
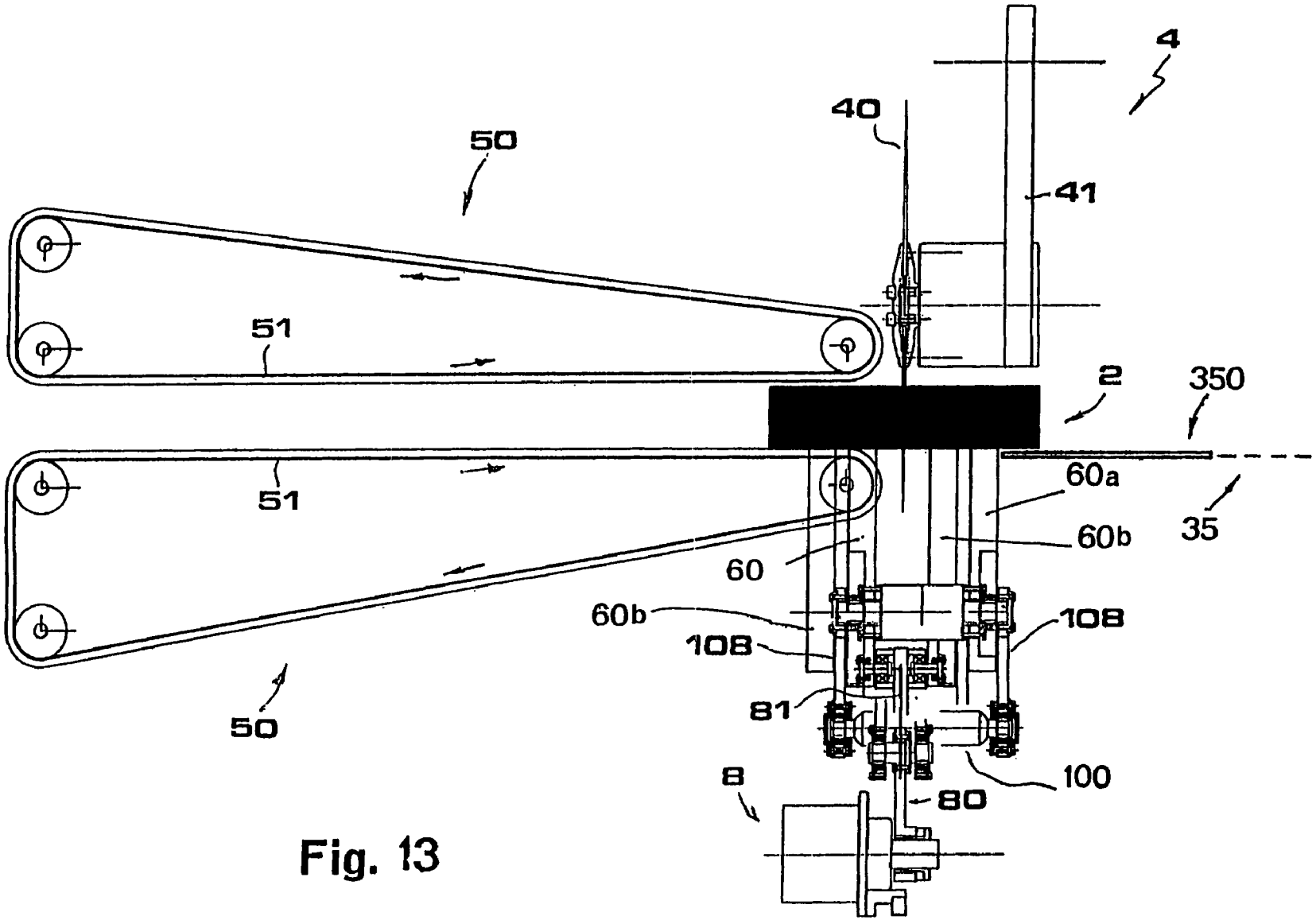
FIG. 13 is a schematic side view of the retention means illustrated in FIGS. 10 and 11.

When the cutting means (4) are inoperative and away from logs (2), the plates (60*a*, 60*b*) are lifted (as shown with solid line in FIG. 12) so that the logs (2) result free of translating forwards (owing to the pull exerted thereon by the said belts 50). Just before the beginning of the step for the cutting of logs (2), that is, when these result in cutting position, the plates (60*a*, 60*b*) are lowered (see FIGS. 10 and 11 and the drawing with dashed lines in FIG. 12) by compressing the surface of the logs by means of the hooks (61) which, being approximately semicircular and in mirror-like relationship, embrace the logs laterally and on top as well, thereby retaining them in the preset position. At the bottom, the logs (2) rest in part on respective belts (50) and in part on the plane (350). The lowering and lifting of the plates (60*a*, 60*b*) is caused by the actuator (8) via the array of levers above mentioned.

The controls of pusher means (3), clamping means (5), cutting means (4) and actuator (8), the latter operating the translation of plates (60*a*, 60*b*), are all automated via corresponding programmable electronic means to which optical, photocell-operated, control means (90) are also connected, the latter being disposed along the operative path of the logs (2) at known and preset positions. Such-electronic means are known to those skilled in the industrial automation field and will not, therefore, be described in greater detail.

It is understood that system for moving the logs (2) may be of any suitable type.

Practically, the construction details may vary in any equivalent way as far as the shape, dimensions, elements disposition, nature of the used materials are concerned, without nevertheless departing from the scope of the adopted solution idea and, thereby, remaining within the limits of the protection granted to the present patent.

The invention claimed is:

1. An apparatus for temporarily holding logs for cutting-off machines, the apparatus comprising:

two plates, each plate comprising a plurality of pressers and an appendix sliding within a guide, said plates being associated with an actuator, said actuator driving one of said plates in a substantially straight movement in a direction of one of said guides, said actuator driving another of said plates in said substantially straight movement in a direction of another one of said guides, said pressers being disposed in mirror-like and parallel relationship to each other such that each presser is orthogonal to the logs to be treated.

2. An apparatus according to claim 1, wherein each said guides guide is inclined at a preset angle to the vertical.

3. An apparatus according to claim 1, wherein each said guide is inclined at an angle of 60° to 65° to the vertical.

4. An apparatus according to claim 1, wherein each said appendix has rollers, each said appendix sliding on one of said guides via said rollers.

5. An apparatus according to claim 1, wherein said actuator is an electric motor, said electric motor being connected to the two plates via a transmission device of crank-connecting rod type.

6. An apparatus for cutting off logs comprising:

a holding device comprising two plates, each plate comprising a plurality of pressers and an appendix sliding within a guide, said plates being associated with an actuator, said actuator driving one of said plates in a substantially straight movement in a direction of one of said guides, said actuator driving another one of said plates in said substantially straight movement in a direction of another one of said guides, said pressers being disposed in mirror-like and parallel relationship to each other such that each presser is orthogonal to the logs to be treated;

a cutting means for cutting the logs;

a device for moving the logs, said device comprising a platform with one or more defined channels, said holding device being located downstream of said device, at least one of said channels receiving one of the logs, said device comprising a pusher means mounted to said platform for engaging at least one of the logs in said channels such that at least one of the logs is moved along one of said guide channels in a direction of said cutting means, said cutting means being disposed downstream of said platform, said device further comprising a clamping means disposed intermediate between said pusher means and said cutting means for receiving at least one of the logs from at least one of said channels and for engaging at least one of the logs such that at least one of the logs is driven to as said cutting means.

7. An apparatus according to claim 6, wherein said pusher means comprises a bar disposed transverse to the one or more channels or platform, said pusher means being moved to and from said clamping means by a carriage associated with a corresponding electric motor, said carriage being mounted on said platform such that said carriage slides on two sides of said platform.

8. An apparatus according to claim 6, wherein said clamping means comprises motor-driven, loop-closed belts disposed opposite to each other, with respect to a plane on which the logs arrive sliding on the platform, each belt comprising a belt portion having a length parallel to said plane, one said belt portion being opposite to another said belt portion to define a log receiving space, said log receiving space being substantially equal to an outer diameter of one of the logs.

9. An apparatus for cutting off logs, the apparatus comprising:

a holding device comprising:

a first guide element defining a first appendix space;

a second guide element defining a second appendix space;

a first plate comprising a plurality of first pressers and a first appendix, said first appendix being mounted for movement in said first appendix space such that said first appendix moves from a first position to a second position, said plurality of first pressers being in a first presser gripping position when said first appendix is in said first position, said plurality of first pressers being in a first presser non-gripping position when said appendix is in said second position, each of said first pressers being parallel to another of said first pressers;

a second plate, said second plate comprising a plurality of second pressers and a second appendix, said second appendix being mounted for movement in said second appendix space such that said second appendix moves from a second appendix first position to a second appendix second position, said plurality of second pressers being in a log gripping position when said second appendix is in said second appendix first position, said plurality of second pressers being in a non-log gripping position when said second appendix is in said second appendix second position, each of said second pressers being parallel to another of said second pressers; and an actuator driving said first plate and said second plate in a linear direction such that said first appendix moves within said first appendix space from said first position to said second position and said second appendix moves within said second appendix space from said first position to said second position;

a cutting means for cutting the logs, said cutting means being movable from a non-cutting position to a cutting position;

a platform with one or more defined channels, said holding device being located downstream of said platform, at least one of said channels receiving one or more logs;

a pusher means for engaging at least one of the logs in one or more said channels and moving said at least one of the logs in a direction of said cutting means, said cutting means being disposed downstream of said platform; and a clamping means disposed between said pusher means and said cutting means for receiving at least one of the logs from at least one of said channels such that said clamping means drives at least one of the logs in a direction of said cutting means when said cutting means is in said non-cutting position and for holding the at least one of the logs when said cutting means is in said cutting position, wherein the at least one log is not moved in a direction of said cutting means when said cutting means is in said cutting position, said plurality of first pressers contacting said at least one log in said first presser gripping position, said plurality of second pressers contacting said at least one log in said log gripping position, said plurality of first pressers being in said first presser gripping position when said cutting means is in said cutting position, said plurality of second pressers being in said log gripping position when said cutting means is in said cutting position, said plurality of first pressers being in said first presser non-gripping position when said cutting means is in said non-operative position, said plurality of second pressers being in said non-log gripping position when said cutting means is in said non-operative position, each of said second pressers being orthogonal to the at least one log, each of said first pressers being orthogonal to the at least one log.

10. An apparatus according to claim 9, wherein said pusher means comprises a bar disposed transverse to the channels or platform, said pusher means being moved to and from said clamping means by a carriage associated with a corresponding electric motor, said carriage being mounted on said platform such that said carriage slides on two sides of said platform.

11. An apparatus according to claim 9, wherein said clamping means comprises motor-driven, loop-closed belts disposed opposite to each other, with respect to a plane on which the logs arrive sliding on the platform, each belt comprising a belt portion having a length parallel to said plane, one said belt portion being opposite to another said belt portion to define a log receiving space, said log receiving space being substantially equal to an outer diameter of one of the logs.

* * * * *